US010908554B2

(12) United States Patent
Ishii

(10) Patent No.: US 10,908,554 B2
(45) Date of Patent: Feb. 2, 2021

(54) IMAGE FORMING APPARATUS WITH LUBRICANT APPLICATOR

(71) Applicant: Hewlett-Packard Development Company, L.P., Spring, TX (US)

(72) Inventor: Yasuyuki Ishii, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/647,733

(22) PCT Filed: Oct. 4, 2018

(86) PCT No.: PCT/KR2018/011719

§ 371 (c)(1),
(2) Date: Mar. 16, 2020

(87) PCT Pub. No.: WO2019/088468

PCT Pub. Date: May 9, 2019

(65) Prior Publication Data

US 2020/0233366 A1 Jul. 23, 2020

(30) Foreign Application Priority Data

Oct. 31, 2017 (JP) ..... 2017-210362

(51) Int. Cl.
*G03G 21/00* (2006.01)

(52) U.S. Cl.
CPC ..... *G03G 21/0094* (2013.01); *G03G 21/0047* (2013.01); *G03G 21/0058* (2013.01); *G03G 21/0088* (2013.01); *G03G 2221/0036* (2013.01)

(58) Field of Classification Search
CPC ..... G03G 2221/0036; G03G 21/0094
See application file for complete search history.

(56) References Cited

U.S. PATENT DOCUMENTS

2005/0191099 A1* 9/2005 Yamaguchi ..... G03G 21/0094 399/346
2006/0133872 A1* 6/2006 Sugiura ..... G03G 21/0094 399/346
2010/0178070 A1* 7/2010 Yamada ..... G03G 21/0011 399/44
2011/0176845 A1 7/2011 Kanazawa et al.
(Continued)

FOREIGN PATENT DOCUMENTS

JP 2007-304371 A 11/2007
JP 2008-76831 A 4/2008
(Continued)

OTHER PUBLICATIONS

Machine translation of Kamoda JP 2018-077410 (Year: 2018).*

*Primary Examiner* — Sevan A Aydin
(74) *Attorney, Agent, or Firm* — Jefferson IP Law, LLP

(57) ABSTRACT

An image forming apparatus includes a lubricant application device to apply a lubricant to a photoreceptor surface of the image forming apparatus, and a lubricant residual amount detector to detect a residual amount of the lubricant. The residual amount of the lubricant is compared to a predetermined amount, and a charging device charges the photoreceptor surface by selectively applying a DC voltage of varying voltage to the photoreceptor surface in response to the comparison of the residual amount of the lubricant to the predetermined amount.

15 Claims, 2 Drawing Sheets

(56) References Cited

U.S. PATENT DOCUMENTS

| | | | | |
|---|---|---|---|---|
| 2016/0320742 | A1* | 11/2016 | Ishida | G03G 21/0094 |
| 2017/0045857 | A1* | 2/2017 | Hirai | G03G 21/0094 |
| 2017/0052501 | A1* | 2/2017 | Sasaki | G03G 21/00 |

FOREIGN PATENT DOCUMENTS

| | | | | |
|---|---|---|---|---|
| JP | 2011-197692 | A | | 10/2011 |
| JP | 2012-18427 | A | | 1/2012 |
| JP | 2013-44871 | A | | 3/2013 |
| JP | 2013-45006 | A | | 3/2013 |
| JP | 2014-134579 | A | | 7/2014 |
| JP | 2015-132670 | A | | 7/2015 |
| JP | 2016-102997 | A | | 6/2016 |
| JP | 2018077377 | A | * | 5/2018 |
| JP | 2018077410 | A | * | 5/2018 |
| KR | 10-1216096 | B1 | | 12/2012 |

* cited by examiner

[Fig. 1]
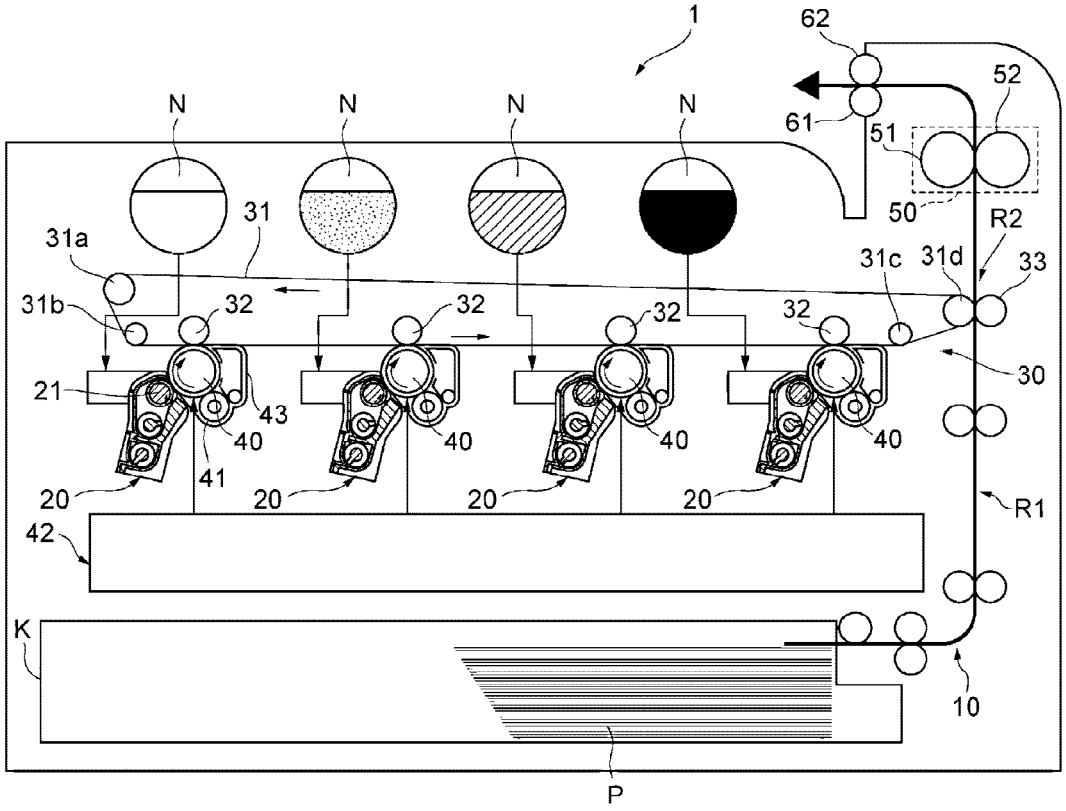

[Fig. 2]
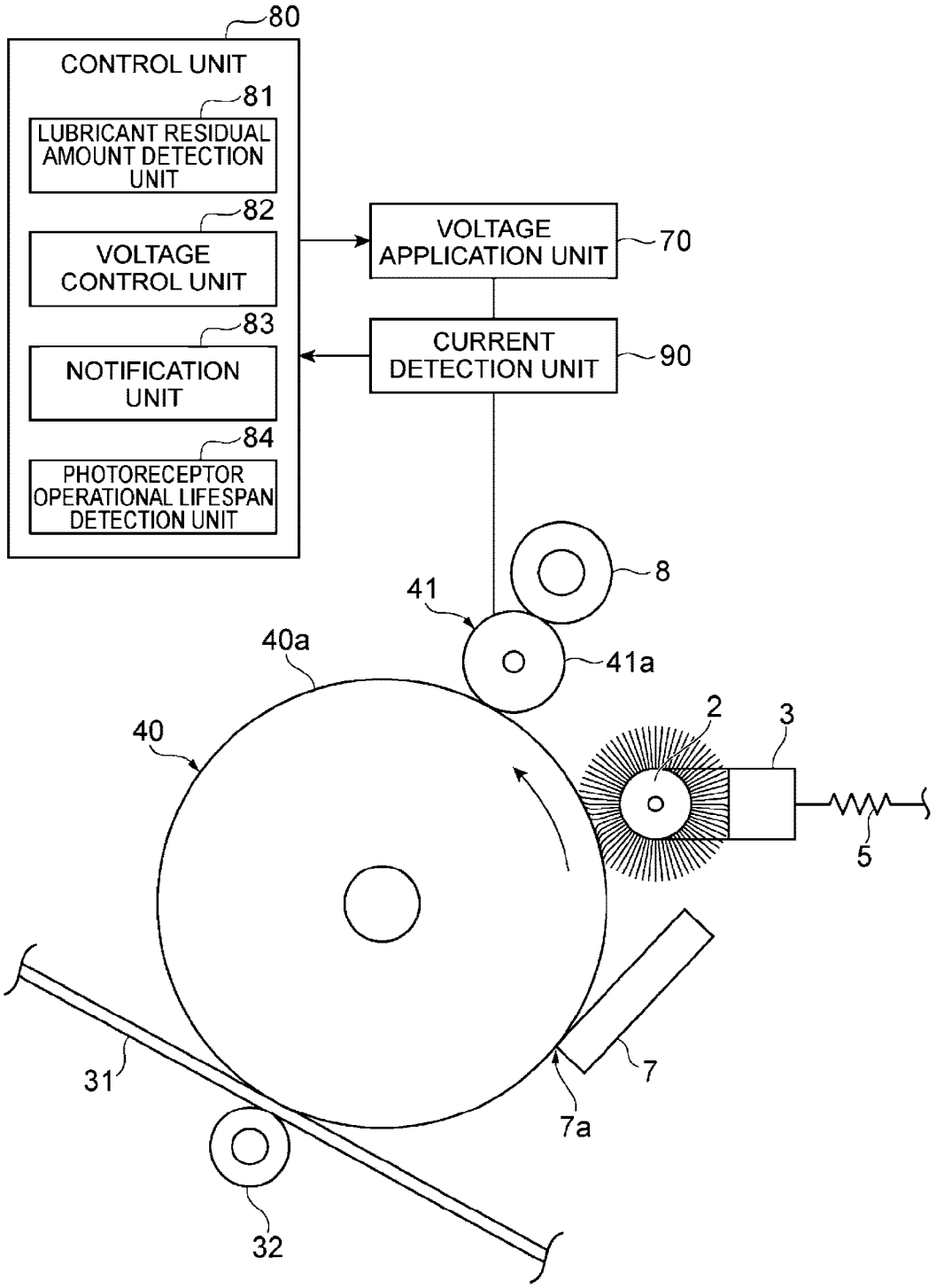

IMAGE FORMING APPARATUS WITH LUBRICANT APPLICATOR

BACKGROUND ART

An image forming apparatus may include a photoreceptor, a lubricant application device that applies a lubricant to a photoreceptor surface, a charging device that charges the photoreceptor surface, and a residual amount detection mechanism that detects a residual amount of the lubricant. When detecting that the residual amount of the lubricant is equal to or less than a predetermined amount, the residual amount detection mechanism further reduces a charging frequency of an AC voltage in a charging bias, in which the AC voltage is superimposed on a DC voltage.

BRIEF DESCRIPTION OF DRAWINGS

FIG. 1 is a schematic configuration diagram of an example image forming apparatus.

FIG. 2 is a schematic configuration diagram of the image forming apparatus as seen from a peripheral direction of a photosensitive drum.

MODE FOR THE INVENTION

In the following description, with reference to the drawings, the same reference numbers are assigned to the same components or to similar components having the same function, and overlapping description is omitted.

Consumption of a lubricant in an image forming apparatus may be suppressed by reducing the charging frequency of the AC voltage in order to increase the operational lifespan of the lubricant. However, when the lubricant is exhausted, downtime of the apparatus occurs until a new lubricant is exchanged.

Disclosed herein is an image forming apparatus with a reduced occurrence of downtime.

An image forming apparatus may include a lubricant application device that applies a lubricant to a photoreceptor surface. The image forming apparatus includes a charging means that charges the photoreceptor surface, and a lubricant residual amount detection means that detects a residual amount of the lubricant. The charging means charges the photoreceptor surface by applying a first voltage composed of a DC voltage to the photoreceptor surface in a case where the lubricant residual amount detection means detects that the residual amount of the lubricant is greater than a predetermined amount. Additionally, the charging means charges the photoreceptor surface by applying a second voltage composed of a DC voltage smaller than the first voltage to the photoreceptor surface in a case where the lubricant residual amount detection means detects that the residual amount of the lubricant is equal to or less than the predetermined amount.

In some examples, the voltage applied to the photoreceptor is changed from the first voltage to the second voltage smaller than the first voltage in correspondence with the residual amount of the lubricant. When the voltage applied to the photoreceptor decreases, an abrasion rate of the photoreceptor is improved, and the operational lifespan of the photoreceptor is lengthened. In a case where the lubricant is exhausted, an image forming operation can continue over a constant period and reduce the downtime of the apparatus.

Another example image forming apparatus may include a lubricant application device that applies a lubricant to a photoreceptor surface. The image forming apparatus includes a charging means that charges the photoreceptor surface, and a lubricant residual amount detection means that detects a residual amount of the lubricant. The charging means charges the photoreceptor surface by applying a first voltage in which an AC voltage is superimposed on a DC voltage to the photoreceptor surface in a case where the lubricant residual amount detection means detects that the residual amount of the lubricant is greater than a predetermined amount. Additionally, the charging means charges the photoreceptor surface by applying a second voltage composed of only a DC voltage to the photoreceptor surface in a case where the lubricant residual amount detection means detects that the residual amount of the lubricant is equal to or less than the predetermined amount.

The voltage applied to the photoreceptor may be changed from the first voltage to the second voltage in correspondence with the residual amount of the lubricant. When the voltage applied to the photoreceptor is changed from the voltage in which the AC voltage is superimposed on the DC voltage to only the DC voltage, an abrasion rate of the photoreceptor is improved, and the operational lifespan of the photoreceptor is lengthened. In a case where the lubricant is exhausted, an image forming operation can continue over a constant period to reduce the downtime of the apparatus.

In addition, the lubricant application device may include an application roller that applies the lubricant to the photoreceptor surface while rotating, and the lubricant residual amount detection means may detect the residual amount of the lubricant on the basis of a travel distance of the application roller. The travel distance of the application roller may be directly measured or may be derived from the number of rotations and an operation time of the photoreceptor, and the like.

In some examples, the image forming apparatus may further include a notification means that gives a notification so that replacement of the photoreceptor may be initiated in a case where the lubricant residual amount detection means detects that the residual amount of the lubricant is equal to or less than the predetermined amount. When the notification means is provided, a user can perform replacement of the photoreceptor at an appropriate timing.

In some examples, the image forming apparatus may further include an operational lifespan detection means that detects an operational lifespan of the photoreceptor and/or a unit that includes the photoreceptor. In a case of detecting the operational lifespan of the photoreceptor and/or the unit that includes the photoreceptor, the operational lifespan detection means prohibits an image forming operation. In some examples, the image forming operation may be prevented from being executed after the photoreceptor and/or the unit that includes the photoreceptor reaches an operational lifespan limit.

In addition, the photoreceptor may contain filler particles to improve the abrasion rate of the photoreceptor.

In addition, the charging means may include a charging roller that comes into contact with the photoreceptor while rotating. In order to maintain a charging uniformity, a ten-point average roughness Rz of a surface of the charging roller may be approximately 5 μm to 30 μm, and an average interval Sm of unevenness in the surface of the charging roller is approximately 30 μm to 500 μm.

Example image forming apparatuses which suppress or reduce the occurrence of downtime are discussed in further detail below.

A schematic configuration of an image forming apparatus 1 is illustrated in FIG. 1. The image forming apparatus 1 forms a color image by using respective colors of magenta, yellow, cyan, and black. As illustrated in FIG. 1, the image forming apparatus 1 may comprise a recording medium conveying unit 10 that conveys paper P, a development device 20 that develops an electrostatic latent image, and a transfer unit 30 that secondarily transfers a toner image to the paper P. Additionally, the image forming apparatus 1 may comprise a photosensitive drum 40 that is an electrostatic latent image carrier in which an image is formed on a peripheral surface, and a fixing unit 50 that fixes the toner image to the paper P.

The recording medium conveying unit 10 conveys the paper P as a recording medium on which an image is formed along a conveyance route R1. The paper P is stacked and accommodated in a cassette K. At a timing at which a toner image to be transferred to the paper P reaches a secondary transfer region R2, the recording medium conveying unit 10 allows the paper P to reach the secondary transfer region R2 through the conveyance route R1.

A separate development device 20 may be provided for every color, for example, four development devices 20 may be provided. Each of the development devices 20 includes a development roller 21 that allows a toner to be carried on the photosensitive drum 40. In the development device 20, the toner and a carrier are adjusted to have a suitable mixing ratio, and the toner and the carrier are mixed and stirred to uniformly disperse the toner, in order to adjust a developer to which an optimal charging amount is applied.

The developer is carried on the development roller 21. In addition, when the developer is conveyed to a region that faces the photosensitive drum 40 due to rotation of the development roller 21, the toner in the developer carried on the development roller 21 moves to an electrostatic latent image formed on the peripheral surface of the photosensitive drum 40, and the electrostatic latent image is developed.

The transfer unit 30 conveys a toner image formed by the development device 20 to the secondary transfer region R2 in which the toner image is secondarily transferred to the paper P. The transfer unit 30 includes a transfer belt 31, suspension rollers 31*a*, 31*b*, 31*c*, and 31*d* which suspend the transfer belt 31, a primary transfer roller 32 that nips the transfer belt 31 in combination with the photosensitive drum 40, and a secondary transfer roller 33 that nips the transfer belt 31 in combination with the suspension roller 31*d*.

The transfer belt 31 is an endless belt that is circulated and moved by the suspension rollers 31*a*, 31*b*, 31*c*, and 31*d*. The primary transfer roller 32 is provided to press the photosensitive drum 40 from an inner periphery side of the transfer belt 31. The secondary transfer roller 33 is provided to press the suspension roller 31*d* from an outer periphery side of the transfer belt 31.

A separate photosensitive drum 40 may be provided for every color (e.g., magenta, yellow, cyan, and black). In some examples, four photosensitive drums 40 are provided. The photosensitive drums 40 are provided along a movement direction of the transfer belt 31. The development device 20, a charging roller 41, an exposure unit 42, and a cleaning unit 43 are provided at the periphery of the photosensitive drum 40.

The charging roller 41 is a charging means that uniformly charges a surface of the photosensitive drum 40 to a predetermined potential. The charging roller 41 moves in conformity to a rotation of the photosensitive drum 40. The exposure unit 42 exposes the surface of the photosensitive drum 40 that is charged by the charging roller 41 in correspondence with an image that is formed on the paper P. Accordingly, the potential of a portion of the surface of the photosensitive drum 40, which is exposed by the exposure unit 42, varies and an electrostatic latent image is formed.

To generate a toner image, the four development devices 20 develop an electrostatic latent image formed on the photosensitive drum 40 by a toner that is supplied from each of toner tanks N provided to respectively face the development devices 20. The toner tanks N are respectively filled with toners of magenta, yellow, cyan, and black. The cleaning unit 43 recovers a toner that remains on the photosensitive drum 40 after the toner image formed on the photosensitive drum 40 is primarily transferred to the transfer belt 31. The photosensitive drum 40 and the charging roller 41 may be attached to a housing that forms the cleaning unit 43. For example, the cleaning unit 43, the photosensitive drum 40, and the charging roller 41 may form a unitary body.

The fixing unit 50 attaches the toner image that is secondarily transferred from the transfer belt 31 to the paper P, and fixes the toner image to the paper P. The fixing unit 50 includes a heating roller 51 that heats the paper P, and a pressure roller 52 that presses the heating roller 51. The heating roller 51 and the pressure roller 52 are formed in a cylindrical shape, and the heating roller 51 includes a heat source such as a halogen lamp at the inside thereof. A fixing nip portion that is a contact region is provided between the heating roller 51 and the pressure roller 52 and when the paper P is allowed to pass through the fixing nip portion, the toner image is fused and fixed to the paper P.

In some examples, the image forming apparatus 1 is provided with ejection rollers 61 and 62 configured to eject the paper P, to which the toner image is fixed by the fixing unit 50, to the outside of the apparatus.

Next, a description will be given of an example printing process that may be performed by the image forming apparatus 1. When an image signal of an image to be recorded is input to the image forming apparatus 1, a control unit of the image forming apparatus 1 uniformly charges a surface of the photosensitive drum 40 to a predetermined potential by the charging roller 41 on the basis of the image signal that is received (charging process). Then, the surface of the photosensitive drum 40 is irradiated with laser light by the exposure unit 42 to form an electrostatic latent image (exposure process).

In the development device 20, the electrostatic latent image is developed, and a toner image is formed (development process). The toner image that is formed in this manner is primarily transferred from the photosensitive drum 40 to the transfer belt 31 in a region in which the photosensitive drum 40 and the transfer belt 31 face each other (transfer process). Toner images which are respectively formed on four photosensitive drums 40 are sequentially stacked on the transfer belt 31, and one stacked toner image is formed. In addition, the stacked toner image is secondarily transferred to the paper P that is conveyed from the recording medium conveying unit 10 in the secondary transfer region R2 in which the suspension roller 31*d* and the secondary transfer roller 33 face each other.

The paper P to which the stacked toner image is secondarily transferred is conveyed to the fixing unit 50. When the paper P is allowed to pass between the heating roller 51 and the pressure roller 52 while applying heat and pressure to the paper P, the stacked toner image is fused and fixed to the paper P (fixing process). Then, the paper P is ejected to the outside of the image forming apparatus 1 by the ejection rollers 61 and 62.

Next, the photosensitive drum 40 and the charging roller 41 will be described in further detail.

The photosensitive drum 40 has a configuration in which a photosensitive layer is provided on a conductive support. The conductive support may have conductivity. Examples of the conductive support include a member obtained by shaping a metal such as aluminum, copper, chromium, nickel, zinc, and stainless steel into a drum shape, a sheet shape, or a belt shape, a member obtained by laminating metal foil of aluminum, copper, or the like on a plastic film, and a member obtained by depositing aluminum, indium oxide, tin oxide, and the like on a plastic film. Additionally, the conductive support may include a member in which a conductive material is applied to a metal, a plastic film, paper, and the like alone or in combination with a binder resin, and a conductive layer is formed.

As the photosensitive layer, any one of a negatively-charged stacked type photosensitive layer and a positively-charged single-layer type photosensitive layer may be used. Furthermore, as the negatively-charged stacked type photosensitive layer, a charge generation layer and a charge transport layer provided on the charge generation layer are provided. The negatively-charged stacked type photosensitive layer has a configuration in which the charge transport layer is stacked on the charge generation layer.

The charge generation layer is a layer containing a charge generation material having a charge generation function as a main component, and may contain a binder resin. Examples of charge generation materials that can be used for the charge generation layer include a monoazo pigment, a disazo pigment, an asymmetric disazo pigment, a trisazo pigment, an azo pigment having a carbazole skeleton, an azo pigment having a distyrylbenzene skeleton, an azo pigment having a triphenylamine skeleton, an azo pigment having a diphenylamine skeleton, a perylene pigment, and a phthalocyanine pigment. The charge generation materials may be used alone or two or more kinds thereof may be mixed and used. In some examples, the charge generation layer may include at least one kind of material selected from the group consisting of oxotitanyl phthalocyanine and gallium phthalocyanine to obtain or control particular electrical characteristics.

Examples of the binder resin that can be used in the charge generation layer include polyamide, polyurethane, epoxy resin, polyketone, polycarbonate, a silicone resin, an acrylic resin, polyvinyl butyral, polyvinyl formal, and polyvinyl ketone. The binder resins may be used alone or as a mixture of two or more kinds thereof.

The charge generation material is dispersed in a solvent by using a dispersion method such as a ball mill, an attritor, a sand mill, a bead mill, and ultrasonic waves in combination with the binder resin to obtain a coating solution for forming the charge generation layer on the conductive support.

In some examples, a layer thickness of the charge generation layer is approximately 0.01 μm to 5 μm, and in other examples approximately 0.05 μm to 3 μm.

The charge transport layer may comprise a charge transport structure, a charge transport material, a binder resin, and first filler particles. For example, the charge transport layer may be formed from an organic compound and the first filler particles. Additionally, the charge transport layer may contain a hole transport material as a charge transport material, and may contain an electron transport material.

Examples of the binder resin include thermoplastic resins or thermosetting resins such as polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, a polycarbonate resin, a polyarylate resin, other types of similar materials, or any combination thereof.

Examples of the hole transport material include materials such as poly (N-vinylcarbazole) and derivatives thereof, poly (g-carbazolylethyl glutamate) and derivatives thereof, pyrene-formaldehyde condensate and derivatives thereof, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, aminobiphenyl derivatives, benzidine derivatives, diarylmethane derivatives, triaryl-methane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, distyrylbenzene derivatives, and enamine derivative. The hole transport material can be used alone or as a mixture of two or more kinds thereof.

Examples of the electron transport material include a benzoquinone-based compound, a cyanoethylene-based compound, a cyanoquinodimethane-based compound, a fluorenone-based compound, a phenantraquinone-based compound, a phthalic anhydride-based compound, a thiopyran-based compound, a naphthalene-based compound, a diphenoquinone-based compound, and a stilbenequinone-based compound. Examples thereof include electron acceptive materials such as chloranil, bromanil, tetracyanoethylene, tetracyanoquinodimethane, and 7-trinitro-9-fluorenone. The electron transport materials may be used alone or as a mixture of two or more kinds thereof.

As the first filler particles, organic filler particles or inorganic filler particles can be used. The organic compound that forms the charge transport layer becomes brittle due to discharging by charging rollers. However, as the first filler particles, when selecting first filler particles formed from a material that is less susceptible to discharging in comparison to the organic compound, it is possible to improve abrasion of the photoreceptor. Examples of the inorganic filler particles include inorganic filler particles formed from a metal oxide material such as silica, alumina, and titanium oxide, or any combination thereof. Additionally, a fluorine-based polymer may be used as the organic filler particle, and examples thereof include a tetrafluoroethylene.ethylene copolymer (ETFE), a tetrafluoroethylene.perfluoroalkyl.vinyl ether copolymer (PFA), a trifluorochloroethylene.ethylene copolymer (ECTFE), polyvinylidene fluoride (PVDF), polytetrafluoroethylene (PTFE), polytrifluoroethylene chloride (PCTFE), polyvinyl fluoride (PVF), ethylene tetrafluoride.hexafluoropropylene (FEP), and tetrafluoroethylene-.hexafluoropropylene.perfluoroalkyl.vinyl ether copolymer (EPE), or any combination thereof.

The charge transport material and the binder resin are dissolved in a solvent to obtain a coating solution for forming the charge transport layer on the charge generation layer.

In some examples a layer thickness of the charge transport layer is approximately 5 μm to 40 μm, and in other examples approximately 10 μm to 35 μm.

The positively-charged single-layer type photosensitive layer has a configuration in which at least the charge generation material, the hole transport material, and the electron transport material are dispersed in a single layer formed from the binder resin. As in the negatively-charged stacked type, the respective materials can be used alone or as a mixture of two or more kinds thereof.

The positively-charged single-layer type photosensitive layer can be formed by the same or similar method as described in the negatively-charged stacked type. For example, the above-described materials may be dispersed or dissolved in a solvent that contains the binder resin to obtain a coating solution, the coating solution is applied to a conductive support, and the binder resin is solidified.

With regard to the first filler that is added, the same material as in the negatively-charged stacked type can be used.

In some examples, a layer thickness of the positively-charged single-layer type photosensitive layer is approximately 5 μm to 40 μm, and in other examples approximately 10 μm to 35 μm.

In other examples, an outermost layer may not be the photosensitive layer. As described in further detail below, the outermost layer of the photoreceptor may have surface properties due to the filler, and other layers such as a protective layer formed from an organic compound may be further provided on the photosensitive layer. In some examples, the photosensitive layer may not contain the first filler, and the first filler may instead be contained only in the protective layer.

As previously discussed, the protective layer may include the first filler and a curable resin obtained by curing a compound. The compound may include a plurality of polymerizable functional groups. The protective layer may be formed as follows. For example, a compound including at least a polymerizable functional group is dissolved in a solvent, and the first filler is further contained in the resultant dissolved compound to obtain an application solution for the protective layer. A coating film is obtained from the application solution for the protective layer, and the coating film is cured (polymerized) by using crosslinking or a polymerization reaction, thereby obtaining the protective layer. The compound including the polymerizable functional group may be a polymerizable monomer, or an oligomer from a dimer in which a plurality of the polymerizable monomers are connected. Examples of the compound including the polymerizable functional group include compounds that include a chain polymerizable functional group such as an acryloyloxy group, a methacryloyloxy group, and a styryl group, or any combination thereof. Other example compounds include a successive polymerizable function group such as a hydroxyl group, an alkoxysilyl group, an isocyanate group, and an epoxy group, or any combination thereof.

Additionally, a curing reaction may be used including, for example, radical polymerization, ionic polymerization, thermal polymerization, photopolymerization, radiation polymerization (electron beam polymerization), a plasma CVD method, an optical CVD method, or any combination thereof.

A charge transport material may be added to the application solution for the protective layer to provide additional charge transport capability of the protective layer. In addition, an additive may be added to provide various functions. Examples of the additive include conductive particles, an antioxidant, an ultraviolet absorber, a plasticizer, and a leveling agent, or any combination thereof.

In some examples, a layer thickness of the protective layer is 0.1 μm to 10 μm, and in other examples 1 μm to 7 μm.

The charging roller can include a conductive support, a conductive elastic body layer provided on an outer peripheral surface of the conductive support, and a resin layer that is provided on an outer peripheral surface of the conductive elastic body layer. The conductive support may be formed from a metal having conductivity. For example, as the conductive support, a metal hollow body (pipe shape), a metal solid body (rod shape), or the like formed from iron, copper, aluminum, nickel, stainless steel, and the like can be used. The outer peripheral surface of the conductive support may be subjected to a plating treatment to a certain extent in which conductivity is not damaged for application of rust prevention and scratch resistance. In addition, an adhesive, a primer, and the like may be applied to the outer peripheral surface to enhance adhesiveness with the conductive elastic body layer. At this time, the adhesive, the primer, and the like may be made to have conductivity.

For example, the conductive support has a circular column shape in which a diameter is approximately 5 mm to 10 mm, and a length is approximately 250 mm to 360 mm.

The conductive elastic body layer may be provided to secure uniform adhesiveness with respect to the photoreceptor. For example, the conductive elastic body layer is formed by using a natural rubber; a synthetic rubber such as an ethylenepropylene-diene rubber (EPDM), a styrene-butadiene rubber (SBR), a silicone rubber, a polyurethane-based elastomer, an epichlorohydrin rubber, an isoprene rubber (IR), a butadiene rubber (BR), an acrylonitrile-butadiene rubber (NBR), hydrogenated NBR (H-NBR), and chloroprene rubber (CR); a synthetic resin such as a polyamide resin, a polyurethane resin, and a silicone resin; and the like as a base polymer. These may be used alone or in combination of two or more kinds.

An additive such as a conducting agent, a vulcanizing agent, a vulcanization accelerator, a lubricant, and/or an auxiliary agent may be blended to the base polymer to apply certain characteristics to the conductive elastic body layer.

Furthermore, examples of the conducting agent include carbon black, graphite, potassium titanate, iron oxide, conductive titanium oxide (c-$TiO_2$), conductive zinc oxide (c-ZnO), conductive tin oxide (c-$SnO_2$), quaternary ammonium salt, and the like, or any combination thereof. Examples of the vulcanizing agent include sulfur, and the like. Examples of the vulcanization accelerator include tetramethylthiuram disulfide (CZ), and the like. Examples of the lubricant include stearic acid, and the like. Examples of the auxiliary agent include zinc oxide (ZnO).

In some examples, the thickness of the conductive elastic body layer is approximately 1.25 mm to 3.00 mm to exhibit elasticity.

The resin layer contains a matrix material and second filler particles. The matrix material may be selected so as not to contaminate the photoreceptor that is an object to be charged. In some examples, the matrix material may include a base polymer such as a fluororesin, a polyamide resin, an acrylic resin, a nylon resin, a polyurethane resin, a silicone resin, a butyral resin, a styrene-ethylene.butylene-olefin copolymer (SEBC), and an olefin-ethylene.butylene-olefin copolymer (CEBC). These may be used alone or in combination of two or more kinds. In some examples, from the viewpoints of easiness of handling, the magnitude of the degree of freedom of material design, and the like, the matrix material may comprise at least one kind of material that is selected from the group consisting of the fluororesin, the acrylic resin, the nylon resin, the polyurethane resin, and the silicone resin, and in some examples at least one kind that is selected from the group of materials consisting of the nylon resin and the polyurethane resin.

The thickness of the resin layer, that is, a layer thickness (thickness of a layer) of a portion that is formed from the matrix material alone may be approximately 1.0 μm to 15.0 μm. Furthermore, the thickness of the resin layer can be measured by cutting a roller cross-section with a sharpedged tool and by observing the cross-section with an optical microscope or an electron microscope.

The second filler particles are not particularly limited as long as the second filler particles can form an unevenness with respect to a surface of a resin layer to sufficiently secure discharging points. Examples of a material suitable for organic filler particles include a urethane resin, a polyamide resin, a fluororesin, a nylon resin, an acrylic resin, a urea resin, and the like. Examples of a material suitable for inorganic filler particles include silica, alumina, and the like. These may be used alone or in combination of two or more kinds.

A shape of the second filler particles may be selected such that an unevenness can be formed with respect to a surface of the resin layer, and may be a spherical shape, an elliptical spherical shape, an irregular shape, and the like.

Furthermore, in addition to the above-described example particles, various conducting agents (conductive carbon, graphite, copper, aluminum, nickel, iron particles, conductive tin oxide, conductive titanium oxide, ion conducting agent, and the like), a charging control agent, and the like may be contained in the base polymer.

In some examples, the charging roller may comprise a rough surface to maintain uniformity of charging with DC current application. For example, a ten-point average roughness Rzjis of the surface of the resin layer may be approximately 5 μm to 30 μm, and Sm may be approximately 30 μm to 500 μm. During a method of roughening a surface by polishing an elastic rubber, a cord-shaped charging irregularity may sometime occur due to a polishing trace. In some examples, particles are added to the charging roller surface. When particles are added to the vicinity of an elastic rubber surface, discharging is likely to occur at a particle portion, and when the particles are added uniformly, discharging becomes uniform and the cord-shaped charging irregularity may be suppressed. Measurement of the surface roughness can be performed by using a surface roughness measurement device SE-3400 manufactured by Kosaka Laboratory Ltd. in conformity to JIS B0601-2001.

For example, the charging roller can be manufactured as follows. First, a material for a conductive elastic body layer is kneaded by using a kneading machine such as a kneader to prepare the material for the conductive elastic body layer. In addition, a material for a resin layer is kneaded by using a kneading machine such as roller, an organic solvent is added to the mixture, and the mixture is mixed and stirred, thereby preparing an application solution for the resin layer. Next, an injection mold, in which a core metal that becomes the conductive support is set, is filled with the material for the conductive elastic body layer, and heating and cross-linking are performed under predetermined conditions. Then, the mold is removed. According to this, a base roll in which the conductive elastic body layer is formed along an outer peripheral surface of the conductive support is manufactured. Then, the outer peripheral surface of the base roll is coated with the application solution for the resin layer to form the resin layer. In some examples, the charging roller may comprise a conductive elastic body layer formed on the outer peripheral surface of the conductive support, and the resin layer is formed on the outer peripheral surface of the conductive elastic body layer.

In addition to or instead of using an injection molding method, the method of forming the conductive elastic body layer may comprise a casting molding method, a press molding method, a roll coating method, and a method combined with polishing. In addition, the coating method of the application solution for the resin layer may comprise a dipping method, a spray coating method, a roll coating method, and the like.

Hereinafter, description will be given of an example image forming apparatus which includes the photoreceptor and the charging means.

An example image forming apparatus may include at least a photoreceptor, and a charging means that comes into contact with the photoreceptor while rotating and charges a photoreceptor surface with discharging by a direct current. The photoreceptor includes a layer formed from an organic compound as an outermost layer, the layer formed from the organic compound contains approximately 1% by mass to 16% by mass of first filler particles having an average particle size of approximately 50 nm to 500 nm. Additionally, the charging means includes a resin layer as an outermost layer, and the resin layer contains second filler particles having an average particle size of approximately 3 μm to 15 μm.

In some examples, the average particle size of the first filler particles is approximately 50 nm to 500 nm from the viewpoint of reducing abrasion of the photoreceptor and of obtaining or controlling particular printing characteristics in a relationship with other configurations of this aspect, and in other examples the average particle size is approximately 100 nm to 300 nm.

Furthermore, the average particle size of the particles can be derived as follows. A number of particles, for example 100 particles, may be extracted from a plurality of particle populations through SEM observation, and the average particle size may be derived from an average value of particle sizes of the extracted particles. However, in a case where a particle shape is not a spherical shape, a particle size may not be determined in the same way as in an elliptical spherical shape (sphere having an elliptical cross-section). Instead, a simple average value between the longest major axis and the shortest minor axis can be set as the particle size of the particles.

The amount of the first filler particles contained may be approximately 1% by mass to 16% by mass from the viewpoint of reducing abrasion of the photoreceptor and of obtaining or controlling particular printing characteristics in a relationship with other configurations of this aspect, and in other examples the amount of the first filler particles contained may be approximately 5% by mass to 12% by mass.

The amount of the filler particles can be determined as follows. For example, a layer that contains the filler particles is sampled. A weight variation (TG), differential heat (DTA), the amount of heat (DSC), and the mass of volatile components (MS) are measured by heating the sampled layer to determine the amount of the filler particles contained (TG-DTA-MS, DSC (thermal analysis)).

The average particle size of the second filler particles is approximately 15 μm or less and in some examples 12 μm or less from the viewpoint of obtaining or controlling particular printing characteristics. Furthermore, the lower limit of the average particle size can be set to approximately 3 μm or greater to control a particular surface roughness of the resin layer.

In some examples, the amount of the second filler particles contained is approximately 5 parts by mass to 80 parts by mass on the basis of 100 parts by mass of a resin that constitutes the matrix material, that is, 5 phr to 80 phr. An amount of the second filler particles of approximately 5 phr or greater may be selected to control a charging performance. On the other hand, an amount of the second filler particles of approximately 80 phr or less may be selected to control particle sedimentation of a coating material, and to maintain coating material stability. In some examples, the amount of the second filler particles contained is approximately 10 phr to 70 phr.

Another example image forming apparatus may include at least a photoreceptor, and a charging means that comes into contact with the photoreceptor while rotating and charges a photoreceptor surface with discharging by a direct current. The photoreceptor includes a layer formed from an organic compound as an outermost layer, the layer formed from the organic compound contains approximately 1% by mass to 16% by mass of first filler particles having an average particle size of approximately 50 nm to 100 nm. Additionally, the charging means includes a resin layer as an outermost layer, and the resin layer contains second filler particles having an average particle size of approximately 3 μm to 30 μm.

In this aspect, the average particle size of the first filler particles is approximately 50 nm to 100 nm from the viewpoint of reducing abrasion of the photoreceptor and of obtaining or controlling particular printing characteristics.

The amount of the first filler particles contained is approximately 1% by mass to 16% by mass from the viewpoint of reducing abrasion of the photoreceptor and of obtaining or controlling particular printing characteristics, and in other examples the amount of the first filler particles contained is approximately 5% by mass to 12% by mass.

The average particle size of the second filler particles is approximately 30 μm or less from the viewpoint of obtaining or controlling particular printing characteristics. Furthermore, the lower limit of the average particle size is set to approximately 3 μm or greater to provide or control a particular surface roughness of the resin layer. In some examples, the lower limit is approximately 20 μm or greater from the viewpoint of suppressing a cord-shaped abnormal image.

An amount of the second filler particles contained in the example image forming apparatus may be approximately the same as previously described.

Yet another example image forming apparatus may include at least a photoreceptor, and a charging means that comes into contact with the photoreceptor while rotating and charges a photoreceptor surface with discharging by a direct current. The photoreceptor includes a layer formed from an organic compound as an outermost layer, and the layer formed from the organic compound contains approximately 1% by mass to 12% by mass of first filler particles having an average particle size of approximately 50 nm to 500 nm. Additionally, the charging means includes a resin layer as an outermost layer, and the resin layer contains second filler particles having an average particle size of approximately 3 μm to 30 μm.

The average particle size of the first filler particles is approximately 50 nm to 500 nm from the viewpoint of reducing abrasion of the photoreceptor and of obtaining or controlling particular printing characteristics in a relationship with other configurations of this aspect, and in some examples the average particle size is approximately 100 nm to 300 nm.

The amount of the first filler particles contained is approximately 1% by mass to 12% by mass from the viewpoint of reducing abrasion of the photoreceptor and of obtaining or controlling particular printing characteristics, and in some examples the amount of the first filler particles contained is approximately 2% by mass to 5% by mass.

The average particle size of the second filler particles is approximately 30 μm or less from the viewpoint of obtaining or controlling particular printing characteristics. Furthermore, the lower limit of the average particle size is set to approximately 3 μm or greater in order to obtain a particular surface roughness of the resin layer surface. In some examples, the lower limit is approximately 20 μm or greater from the viewpoint of suppressing a cord-shaped abnormal image.

An amount of the second filler particles contained in the example image forming apparatus may be approximately the same as previously described.

In some examples, a specific dielectric constant of the first filler particles may be equal to or greater than a specific dielectric constant of an organic compound that contains the first filler particles. For example, in a case where polycarbonate (specific dielectric constant: 3.1) is employed as the binder resin of the charge transport layer, and silica particles (specific dielectric constant: 3.6) may be employed as the first filler particles, the specific dielectric constant of the first filler particles may be equal to or greater than the specific dielectric constant of the binder resin. Accordingly, a decrease in charging potential according to a local decrease in dielectric constant, which occurs at a filler portion, is less likely to occur. As a result, even in a case where the particle size of the second filler particles of the charging roller is large to a certain extent, and irregularity of a surface potential on the photoreceptor exists, the influence on a dot area deviation may be reduced, as described below in further detail.

Next, an example configuration in the vicinity of the photosensitive drum 40 and the charging roller 41 in the image forming apparatus 1 will be described in detail with reference to FIG. 2.

FIG. 2 is an example schematic configuration diagram when parts of the image forming apparatus 1 are seen from an axial direction of the photosensitive drum 40. However, in FIG. 2, the development device 20 illustrated in FIG. 1 is partially omitted for simplicity.

As illustrated in FIG. 2, the example image forming apparatus 1 further includes an application roller 2 that is a lubricant application device that applies a lubricant 3 to the photosensitive drum 40, and a cleaning blade 7 that removes a transfer residual toner that remains on a surface 40*a* of the photosensitive drum 40. Additionally, the image forming apparatus 1 may comprise a cleaning roller 8 that removes foreign matters including a toner adhered to a surface 41*a* of the charging roller 41, and a voltage application unit (voltage application means) 9 that applies a voltage to the charging roller 41.

In some examples, organic or inorganic fine particles are contained in the surface 40*a* of the photosensitive drum 40. Examples of the organic or inorganic fine particles include silica fine particles, alumina, PTFE resin particles, titanium, and the like, or any combination thereof.

The lubricant 3 may be a solid substance. A hardness of the lubricant 3 may be approximately 3.0 to 7.0 in micro Vickers. Examples of a composition of the lubricant 3 includes zinc stearate, barium stearate, lead stearate, iron stearate, nickel stearate, cobalt stearate, copper stearate, strontium stearate, calcium stearate, cadmium stearate, magnesium stearate, zinc oleate, manganese oleate, iron oleate, cobalt oleate, lead oleate, magnesium oleate, copper oleate, zinc palmitate, cobalt palmitate, copper palmitate, magnesium palmitate, aluminum palmitate, calcium palmitate, lead caprylate, lead caproate, lead linolenate, calcium linolenate, cadmium linolenate, and the like, or any combination thereof.

The application roller 2 is disposed downstream of the cleaning blade 7 in a rotation direction of the photosensitive drum 40. The lubricant 3 is pressed to the application roller 2 by an elastic body 5. The application roller 2 scrapes the solid lubricant 3 and applies the scraped lubricant 3 to the surface 40*a* of the photosensitive drum 40 while rotating. A density of the application roller is approximately 30 K pieces/inch$^2$ to 120 K pieces/inch$^2$, and the thickness of an application brush is approximately 3 d (denier) to 9 d.

The cleaning blade 7 is a plate-shaped member that is constituted by an elastic body such as a urethane rubber. The cleaning blade 7 extends in an axial direction of the photosensitive drum 40. The cleaning blade 7 pressurizes the surface 40*a* of the photosensitive drum 40 to scrape a transfer residual toner that remains on the surface 40*a* of the photosensitive drum 40 with a tip end 7*a*, and removes the transfer residual toner from the surface 40*a* of the photosensitive drum 40.

The cleaning roller 8 extends in an axial direction of the charging roller 41 and is in contact with a surface 41*a* of the charging roller 41. The cleaning roller 8 moves in conformity to the charging roller 41. The cleaning roller 8 removes foreign matters adhered to the surface 41*a* of the charging roller 41 to suppress contamination of the charging roller 41.

In some examples, a voltage application unit 70 includes a DC power supply, and applies a DC voltage to the charging roller 41. The voltage application unit 70 is controlled by a control unit 80. The control unit 80 is a functional unit and includes a lubricant residual amount detection unit (lubricant residual amount detection means) 81, a voltage control unit 82, a notification unit (notification means) 83, and a photoreceptor operational lifespan detection unit (photoreceptor operational lifespan detection means) 84. The control unit 80 may comprise a computer, and respective functional units may be respectively realized by a plurality of computers.

The lubricant residual amount detection unit 81 detects a residual amount of the lubricant 3. For example, the lubricant residual amount detection unit 81 is provided with a table, a mathematical formula, and the like which represent a relationship between a travel distance of the application roller 2 and a residual amount of the lubricant 3, and detects the residual amount of the lubricant 3 on the basis of the travel distance of the application roller 2. The travel distance of the application roller 2 can be acquired, for example, by measuring a rotation time from initiation of rotation of the application roller 2 to termination of the rotation. In addition, the travel distance of the application roller 2 in an image forming operation performed once can be measured in advance. Accordingly, the travel distance of the application roller 2 may be acquired from the number of image formations in one job. In addition, the travel distance of the application roller 2 may be measured, for example, by using a rotary encoder. In addition, the number of rotations of the photosensitive drum 40 and the travel distance of the application roller 2 has a correlation, and thus the travel distance of the application roller 2 may be derived from the number of rotations of the photosensitive drum 40.

In some examples, the lubricant residual amount detection unit 81 can determine whether or not the residual amount of the lubricant 3 is greater than a predetermined amount or the residual amount of the lubricant 3 is equal to or less than the predetermined amount. For example, the lubricant residual amount detection unit 81 detects a case where the residual amount of the lubricant 3 becomes zero as the predetermined amount. In addition, the lubricant residual amount detection unit 81 may detect a case where the lubricant 3 becomes a near end as the predetermined amount. The lubricant residual amount detection unit 81 outputs information indicating that the residual amount of the lubricant 3 is greater than the predetermined amount or equal to or less than the predetermined amount to the voltage control unit 82 and the notification unit 83.

The voltage control unit 82 controls a voltage that is applied from the voltage application unit 70 to the charging roller 41 by controlling the voltage application unit 70. In some examples, in a case where it is detected that the residual amount of the lubricant 3 is greater than the predetermined amount, the voltage control unit 82 controls the voltage application unit 70 so that a first voltage composed of a DC voltage is applied to the photosensitive drum 40. For example, in a case where the residual amount of the lubricant 3 is not zero, the surface 41*a* of the photosensitive drum 40 is charged with application of the first voltage. As an example, the first voltage may be −1400 V.

In addition, in a case where it is detected that the residual amount of the lubricant 3 is equal to or less than the predetermined amount, the voltage control unit 82 controls the voltage application unit 70 so that a second voltage composed of a DC voltage smaller than the first voltage is applied to the photosensitive drum 40. For example, in a case where the residual amount of the lubricant 3 becomes zero, the surface 41*a* of the photosensitive drum 40 is charged with application of the second voltage. As an example, the second voltage may be −1300 V that is equal to or greater than a discharging initiation voltage.

In a case where it is detected that the residual amount of the lubricant 3 is equal to or less than the predetermined amount, the notification unit 83 gives a notification so that replacement preparation of the photosensitive drum 40 is initiated. In a case where the residual amount of the lubricant 3 becomes zero, a notification indicating initiation of replacement preparation of the photosensitive drum 40 is given. For example, the notification unit 83 performs the notification by displaying a message or an image on a display unit that is provided in the image forming apparatus 1, or an external computer that is connected to the image forming apparatus 1. In addition, the notification may be performed with a voice. In some examples, the photosensitive drum 40 included in the cleaning unit 43 can be replaced with a new one by replacing the cleaning unit 43 with a new one. Furthermore, in a case where the photosensitive drum 40 is not included in the cleaning unit 43, only the photosensitive drum 40 may be replaced with a new one.

The photoreceptor operational lifespan detection unit 84 detects the operational lifespan of the photosensitive drum 40, and prohibits an image forming operation in a case where the operational lifespan of the photosensitive drum 40 is detected. The detection of the operational lifespan of the photosensitive drum 40 can be performed by detecting a discharging current that flows to the photosensitive drum 40. In some examples, a current detection unit 90 is provided between the voltage application unit 70 and the photosensitive drum 40. The current detection unit 90 detects the magnitude of a current that flows from the voltage application unit 70 to the photosensitive drum 40, and outputs a detection result to the photoreceptor operational lifespan detection unit 84. The photoreceptor operational lifespan detection unit 84 detects the operational lifespan of the photosensitive drum 40 on the basis of the magnitude of the current that is detected. In some examples, a film thickness of the charge transport layer becomes equal to or less than a predetermined amount due to abrasion, and therefor determines the operational lifespan of the photosensitive drum 40. The magnitude of the current that flows from the voltage application unit 70 to the photosensitive drum 40 increases as the film thickness of the charge transport layer becomes smaller. Accordingly, in a case where a current equal to or greater than a predetermined threshold value is detected by the current detection unit 90, the photoreceptor operational lifespan detection unit 84 makes a determination as an operational lifespan limit of the photosensitive drum 40. Furthermore, in a case where the photosensitive drum 40 is provided in the cleaning unit 43, the operational lifespan limit of the photosensitive drum 40 is an operational lifespan limit of the cleaning unit 43.

In some example image forming apparatus, a voltage that is applied to the photosensitive drum 40 is changed from the first voltage to the second voltage smaller than the first voltage in correspondence with the residual amount of the lubricant 3. When the voltage applied to the photosensitive drum 40 decreases, an abrasion rate of the photosensitive drum 40 is improved, and the operational lifespan of the photosensitive drum 40 is lengthened. In a case where the lubricant 3 is exhausted, an image forming operation can continue over a constant period to reduce the downtime of the apparatus.

The lubricant residual amount detection unit 81 detects the residual amount of the lubricant 3 on the basis of the travel distance of the application roller 2. For example, the travel distance of the application roller 2 may be directly measured, or may be derived from the number of rotations and an operation time of the photosensitive drum 40, and the like.

The notification unit 83 gives a notification so that a replacement preparation of the photosensitive drum 40 is initiated in a case where the lubricant residual amount detection unit 81 detects that the residual amount of the lubricant 3 is equal to or less than a predetermined amount. Accordingly, a user can perform replacement of the photosensitive drum 40 at an appropriate timing, and thus occurrence of downtime is suppressed or reduced.

In a case where the operational lifespan of the photosensitive drum 40 is detected, the photoreceptor operational lifespan detection unit 84 may prohibit an image forming operation. In some examples, the downtime does not occur before reaching the operational lifespan limit of the photosensitive drum 40, and thus the image forming operation can be executed. On the other hand, after the photosensitive drum 40 reaches the operational lifespan limit, execution of the image forming operation may be prevented.

In addition, the photosensitive drum 40 contains the filler particles to control or reduce an abrasion rate of the photosensitive drum 40.

In some examples, the 10-point average roughness Rz of the surface 41*a* of the charging roller 41 is approximately 5 μm to 30 μm, and the average interval Sm of the unevenness in the surface 41*a* is approximately 30 μm to 500 μm in order to maintain or control a charging uniformity.

Another image forming apparatus will be described which differs in configuration of the voltage application unit and the voltage control unit.

The voltage application unit 70 can apply a first voltage in which an AC voltage is superimposed on a DC voltage to the photosensitive drum 40. Accordingly, the voltage application unit 70 includes a DC power supply and an AC power supply.

The voltage control unit 82 controls a voltage that is applied from the voltage application unit 70 to the charging roller 41 by controlling the voltage application unit 70. In a case where it is detected that the residual amount of the lubricant 3 is greater than the predetermined amount, the voltage control unit 82 controls the voltage application unit 70 so that a first voltage in which an AC voltage is superimposed on a DC voltage is applied to the photosensitive drum 40. For example, in a case where the residual amount of the lubricant 3 is not zero, the surface 41*a* of the photosensitive drum 40 is charged with application of the first voltage. As an example, in the first voltage, the DC voltage may be approximately −700 V and the AC voltage may be approximately 1400 Vpp.

In addition, in a case where it is detected that the residual amount of the lubricant 3 is equal to or less than the predetermined amount, the voltage control unit 82 controls the voltage application unit 70 so that a second voltage composed of only a DC voltage is applied to the photosensitive drum 40. For example, in a case where the residual amount of the lubricant 3 becomes zero, the surface 41*a* of the photosensitive drum 40 is charged with application of the second voltage. As an example, the second voltage may be approximately −1400 V that is equal to or greater than a discharging initiation voltage.

In some example image forming apparatus, a voltage applied to the photosensitive drum 40 is changed from the first voltage to the second voltage in correspondence with the residual amount of the lubricant 3. The voltage applied to the photosensitive drum 40 is changed from a voltage in which an AC voltage is superimposed on a DC voltage to only a DC voltage, an abrasion rate of the photosensitive drum 40 is improved, and thus the operational lifespan of the photosensitive drum 40 is lengthened. For example, in a charging method using only a direct current, the abrasion rate of the photoreceptor may be improved three times in comparison to a charging method in which an AC voltage is superimposed on a DC voltage, and thus the operational lifespan of the photoreceptor after detection of the residual amount of the lubricant 3 is significantly improved. In a case where the lubricant 3 is exhausted, an image forming operation may be continued to reduce the downtime of the apparatus.

It is to be understood that not all aspects, advantages and features described herein may necessarily be achieved by, or included in, any one particular example. Indeed, having described and illustrated various examples herein, it should be apparent that other examples may be modified in arrangement and detail.

LIST OF REFERENCE NUMBERS

1: image forming apparatus, 2: application roller (lubricant application device), 3: lubricant, 40: photosensitive drum, 40*a*: surface, 41: charging roller (charging means), 41*a*: surface, 70: voltage application unit, 81: lubricant residual amount detection unit (lubricant residual amount detection means), 83: notification unit (notification means), 84: photoreceptor operational lifespan detection unit (operational lifespan detection means).

The invention claimed is:

1. An image forming apparatus comprising:

a photoreceptor having a photoreceptor surface;

a lubricant applicator to apply a lubricant to the photoreceptor surface;

a charging device to charge the photoreceptor surface; and a lubricant residual amount detector to detect a residual amount of the lubricant, the charging device to charge the photoreceptor surface by applying a first voltage composed of a DC voltage to the photoreceptor surface in a case where the lubricant residual amount detector detects that the residual amount of the lubricant is greater than a predetermined amount, and the charging device to charge the photoreceptor surface by applying a second voltage composed of a DC voltage smaller than the first voltage to the photoreceptor surface in a case where the lubricant residual amount detector detects that the residual amount of the lubricant is equal to or less than the predetermined amount.

2. The image forming apparatus according to claim 1, wherein in the case where the lubricant residual amount detector detects that the residual amount of the lubricant is greater than the predetermined amount, an AC voltage is superimposed on the first voltage applied to the photoreceptor surface, and in the case where the lubricant residual amount detector detects that the residual amount of the lubricant is equal to or less than the predetermined amount, only DC voltage is applied to the photoreceptor surface, without superimposing AC voltage on the second voltage.

3. The image forming apparatus according to claim 1, wherein the lubricant applicator includes an application roller to apply the lubricant to the photoreceptor surface while rotating, the lubricant residual amount detector to detect the residual amount of the lubricant on the basis of a travel distance of the application roller.

4. The image forming apparatus according to claim 1, further comprising:

a notification device to provide a notification that replacement preparation of the photoreceptor is initiated in the case where the lubricant residual amount detector detects that the residual amount of the lubricant is equal to or less than the predetermined amount.

5. The image forming apparatus according to claim 1, further comprising:

an operational lifespan detector to detect an operational lifespan of the photoreceptor and/or a unit that includes the photoreceptor, wherein in a case of detecting the operational lifespan of the photoreceptor and/or the unit that includes the photoreceptor, the operational lifespan detector prohibits an image forming operation.

6. The image forming apparatus according to claim 1, wherein the photoreceptor contains filler particles.

7. The image forming apparatus according to claim 1, wherein the charging device includes a charging roller to come into contact with the photoreceptor while rotating, a ten-point average roughness Rz of a surface of the charging roller is approximately 5 μm to 30 μm, and an average interval Sm of unevenness in the surface of the charging roller is approximately 30 μm to 500 μm.

8. An image forming apparatus comprising:

a photoreceptor having a photoreceptor surface;

a lubricant applicator to apply a lubricant to the photoreceptor surface;

a lubricant residual amount detector to detect a residual amount of the lubricant, and to compare the residual amount of the lubricant to a predetermined amount, and a charging device to charge the photoreceptor surface by selectively applying a DC voltage of varying voltage to the photoreceptor surface in response to comparing the residual amount of the lubricant to the predetermined amount.

9. The image forming apparatus according to claim 8, wherein in response to the lubricant residual amount detector determining that the residual amount of the lubricant is greater than the predetermined amount, the charging device to apply a first voltage composed of the DC voltage to the photoreceptor surface, and wherein in response to the lubricant residual amount detector determining that the residual amount of the lubricant is less than or equal to the predetermined amount, the charging device to apply a second voltage smaller than the first voltage to the photoreceptor surface.

10. The image forming apparatus of claim 9, wherein in response to the lubricant residual amount detector determining that the residual amount of the lubricant is greater than the predetermined amount, the charging device to superimpose an AC voltage on the first voltage.

11. The image forming apparatus of claim 10, wherein in response to the lubricant residual amount detector determining that the residual amount of the lubricant is less than or equal to the predetermined amount, the charging device to only apply DC voltage to the photoreceptor surface, without superimposing AC voltage on the second voltage.

12. The image forming apparatus according to claim 8, wherein the lubricant applicator includes an application roller to apply the lubricant to the photoreceptor surface, and the lubricant residual amount detector to detect the residual amount of the lubricant on the basis of a travel distance of the application roller.

13. The image forming apparatus according to claim 8, further comprising:

a notification device that generates a replacement notification in response to the lubricant residual amount detector determining that the residual amount of the lubricant is equal to or less than the predetermined amount.

14. The image forming apparatus according to claim 8, further comprising:

an operational lifespan detector to determine an operational lifespan of the photoreceptor, wherein in response to determining the operational lifespan of the photoreceptor, the operational lifespan detector to prohibit an image forming operation of the image forming apparatus.

15. An image forming apparatus comprising:

a lubricant application device to apply a lubricant to a photoreceptor surface of the image forming apparatus;

a lubricant residual amount detection means to detect a residual amount of the lubricant, and a charging means to charge the photoreceptor surface by selectively applying a DC voltage of varying voltage to the photoreceptor surface in response to a comparison of the residual amount of the lubricant to a predetermined amount, wherein in a case in which the lubricant residual amount is greater than the predetermined amount, the charging means to apply a first voltage composed of the DC voltage to the photoreceptor surface, and wherein in a case in which the residual amount of the lubricant is less than or equal to the predetermined amount, the charging means to apply a second voltage smaller than the first voltage.

* * * * *